US009719706B2

(12) United States Patent
Piesker et al.

(10) Patent No.: US 9,719,706 B2
(45) Date of Patent: Aug. 1, 2017

(54) ACCUMULATOR ARRANGEMENT WITH AN INTEGRATED SUBCOOLER

(71) Applicant: AIRBUS OPERATIONS GMBH, Hamburg (DE)

(72) Inventors: Markus Piesker, Hamburg (DE); Martin Sieme, Hamburg (DE); Johannes Chodura, Hamburg (DE); Ahmet Kayihan Kiryaman, Hamburg (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 550 days.

(21) Appl. No.: 13/773,214

(22) Filed: Feb. 21, 2013

(65) Prior Publication Data

US 2013/0227969 A1 Sep. 5, 2013

Related U.S. Application Data

(60) Provisional application No. 61/602,618, filed on Feb. 24, 2012.

(30) Foreign Application Priority Data

Feb. 24, 2012 (EP) ..... 12 001 232

(51) Int. Cl.
*F25B 39/04* (2006.01)
*F25B 41/00* (2006.01)
(Continued)

(52) U.S. Cl.
CPC ..... *F25B 40/02* (2013.01); *F25B 23/006* (2013.01); *F25B 2339/044* (2013.01); *F25B 2400/053* (2013.01)

(58) Field of Classification Search
CPC ... F25B 39/04; F25B 2339/0441; F25B 40/02
(Continued)

(56) References Cited

U.S. PATENT DOCUMENTS 4,197,719 A * 4/1980 Shaw ..... 62/324.1
4,270,934 A * 6/1981 Widdowson ..... B01D 45/06 55/391
(Continued)

FOREIGN PATENT DOCUMENTS

CN 101419003 4/2009
DE 10 2006 005 035 9/2007
(Continued)

OTHER PUBLICATIONS

Machine Translation of the above JP 2004-190956 to Hiyama, PAJ, all pages.*
Chinese Office Action dated Nov. 21, 2014.

*Primary Examiner* — Allen Flanigan
*Assistant Examiner* — Filip Zec
(74) *Attorney, Agent, or Firm* — Dickinson Wright

(57) ABSTRACT

An accumulator arrangement for use in a cooling system suitable for operation with two-phase refrigerant includes a condenser having a refrigerant inlet and a refrigerant outlet. The accumulator arrangement further includes an accumulator for receiving the two-phase refrigerant therein, the accumulator having a refrigerant inlet connected to the refrigerant outlet of the condenser and a refrigerant outlet. Finally, the accumulator arrangement includes a subcooler having a refrigerant inlet and a refrigerant outlet, the refrigerant inlet of the subcooler being connected to the refrigerant outlet of the accumulators, and the subcooler being arranged at least partially within the interior of the accumulator.

13 Claims, 2 Drawing Sheets

(51) Int. Cl.
*F25B 40/02* (2006.01)
*F25B 23/00* (2006.01)

(58) Field of Classification Search
USPC ..... 62/513, 509
See application file for complete search history.

(56) References Cited

U.S. PATENT DOCUMENTS 4,972,683 A * 11/1990 Beatenbough ..... 62/507
5,146,767 A * 9/1992 Kadle et al. ..... 62/474
5,457,964 A * 10/1995 Hyde ..... F25B 39/04 62/196.3
5,660,058 A * 8/1997 Harris ..... B60H 1/3229 62/471
5,906,112 A * 5/1999 Amin ..... F25B 43/006 62/471
6,418,751 B1 * 7/2002 Telesz ..... F25B 43/006 62/471
7,971,441 B2 7/2011 Salim
8,191,376 B2 * 6/2012 Fox et al. ..... 62/174
8,353,180 B2 * 1/2013 Okamoto ..... F25B 31/004 62/470
2006/0254310 A1 11/2006 Kamsma
2009/0000329 A1 1/2009 Colberg
2009/0107172 A1 4/2009 Salim
2010/0251737 A1 10/2010 Roering
2013/0068430 A1 3/2013 Piesker

FOREIGN PATENT DOCUMENTS

DE 10 2009 011 797 9/2010
DE 10 2011 014 954 9/2012
DE 10 2011 121 745 6/2013
EP 1 640 676 3/2006
EP 1 724 536 11/2006
JP 2002-310537 10/2002
JP 2004-190956 7/2004
JP 2004190956 A * 7/2004
WO 2007/088012 8/2007

* cited by examiner

ACCUMULATOR ARRANGEMENT WITH AN INTEGRATED SUBCOOLER

CROSS REFERENCE TO RELATED APPLICATIONS

This application is entitled to and claims the benefit of European Patent Application No. 12 001 232.3, and U.S. Provisional Application No. 61/602,618,, both filed Feb. 24, 2012,, the disclosures of which, including the specification, drawings and abstract, are incorporated herein by reference in their entirety.

FIELD

The invention relates to an accumulator arrangement for use in a cooling system, in particular an aircraft cooling system, which is suitable for operation with a two-phase refrigerant, and a method of operating an accumulator arrangement of this kind. Further, the invention relates to a cooling system comprising an accumulator arrangement of this kind and a method of operating a cooling system of this kind.

BACKGROUND

Cooling systems for operation with a two-phase refrigerant are known from DE 10 2006 005 035, B3,, WO 2007/088012, A1,, DE 10 2009 011 797, A1, and U.S. 2010/0251737, A1, and may be used for example to cool food that is stored on board a passenger aircraft and intended to be supplied to the passengers. Typically, the food provided for supplying to the passengers is kept in mobile transport containers. These transport containers are filled and pre-cooled outside the aircraft and after loading into the aircraft are deposited at appropriate locations in the aircraft passenger cabin, for example in the galleys. In order to guarantee that the food remains fresh up to being issued to the passengers, in the region of the transport container locations cooling stations are provided, which are supplied with cooling energy from a central refrigerating device and release this cooling energy to the transport containers, in which the food is stored.

In the cooling systems known from DE 10 2006 005 035, B3,, WO 2007/088012, A1, DE 10 2009 011 797, A1, and U.S. 2010/0251737, A1, the phase transitions of the refrigerant flowing through the circuit that occur during operation of the system allow the latent heat consumption that then occurs to be utilized for cooling purposes. The refrigerant mass flow needed to provide a desired cooling capacity is therefore markedly lower than for example in a liquid cooling system, in which a one-phase liquid refrigerant is used. Consequently, the cooling systems described in DE 10 2006 005 035, B3,, WO 2007/088012, A1,, DE 10 2009 011 797, A1, and U.S. 2010/0251737, A1 may have lower tubing cross sections than a liquid cooling system with a comparable cooling capacity and hence have the advantages of a lower installation volume and a lower weight. What is more, the reduction of the refrigerant mass flow makes it possible to reduce the conveying capacity needed to convey the refrigerant through the cooling circuit of the cooling system. This leads to an increased efficiency of the system because less energy is needed to operate a corresponding conveying device, such as for example a pump, and moreover less additional heat generated by the conveying device during operation of the conveying device has to be removed from the cooling system.

In the prior art cooling systems the two-phase refrigerant typically is stored, in the form of a boiling liquid, in an accumulator which is disposed in a cooling circuit allowing circulation of the two-phase refrigerant therethrough. So as to avoid excess wear of a conveying device for discharging the two-phase refrigerant from the accumulator, which may, for example, be designed in the form of a pump, conveying gaseous refrigerant through the conveying device and the formation of gas bubbles (cavitation) in the conveying device should be prevented as far as possible. Cavitation typically is the result of a pressure decrease in the refrigerant due to an abrupt increase of the flow speed caused by rapidly moving pump components.

Non-published DE 10 2011 014 954, therefore proposes an accumulator arrangement for use in a cooling system suitable for operation with a two-phase refrigerant wherein the refrigerant is liquefied and subcooled in a condenser. The subcooled refrigerant exiting the condenser is guided through a heat exchanger disposed within the accumulator and thereafter is discharged into the accumulator. While flowing through the heat exchanger the subcooled refrigerant releases cooling energy to the refrigerant already received in the accumulator.

Further, non-published DE 10 2011 121 745, proposes an accumulator arrangement for use in a cooling system suitable for operation with a two-phase refrigerant, wherein a conveying device for conveying refrigerant from an accumulator is formed integral with the accumulator. The integration of the conveying device into the accumulator allows to dispense with a tubing connecting the accumulator to the conveying device, which, in particular during start-up of the cooling system might contain gaseous refrigerant.

SUMMARY

The invention is directed to the object to provide a small-sized accumulator arrangement for use in a cooling system suitable for operation with a two-phase refrigerant, which allows a low-wear operation of a conveying device for discharging the refrigerant from an accumulator. The invention also is directed to the object to provide a method of operating an accumulator arrangement of this kind. Further, the invention is directed to the object to provide a small-sized cooling system suitable for operation with a two-phase refrigerant, which allows a low-wear operation of a conveying device for discharging the refrigerant from an accumulator, and to a method of operating a cooling system of this kind.

These objects are achieved by an accumulator arrangement having features of attached claims, a method of operating an accumulator arrangement having features of attached claims, a cooling system having features of attached claims, and a is method of operating a cooling system having features of attached claims.

An accumulator arrangement according to the invention is in particular suitable for use in a cooling system for operation with a two-phase refrigerant and comprises a condenser having a refrigerant inlet and a refrigerant outlet. The cooling system may be intended for installation on board an aircraft for cooling heat generating components or food. The two-phase refrigerant is a refrigerant, which upon releasing cooling energy to a cooling energy consumer is converted from the liquid to the gaseous state of aggregation and is then converted back to the liquid state of aggregation. The two-phase refrigerant may for example be $CO_2$, or R134A ($CH_2F—CF_3$). Electric or electronic systems, such as avionic systems or fuel cell systems usually have to be cooled at a higher temperature level than food. For cooling these systems, for example Galden® can be used as a two-phase refrigerant. The evaporating temperature of Galden® at a pressure of 1, bar is approximately 60°, C.

The two-phase refrigerant is supplied to the refrigerant inlet of the condenser in its gaseous state of aggregation. In the condenser, the refrigerant is condensed and hence exits the condenser at the refrigerant outlet of the condenser in its liquid state of aggregation. The condenser can be a part of a chiller or can be supplied with cooling energy from a chiller. For example, the condenser may comprise a heat exchanger which provides for a thermal coupling of the refrigerant flowing through the cooling circuit and a cooling circuit of a chiller. A condenser of a cooling system employing Galden® as the two-phase refrigerant can be operated without a chiller and may, for example, be formed as a fin cooler or outer skin heat exchanger which is cooled by ambient air.

The accumulator arrangement further comprises an accumulator for receiving the two-phase refrigerant therein. The accumulator has a refrigerant inlet connected to the refrigerant outlet of the condenser and a refrigerant outlet. A suitable valve can be provided for controlling the supply of refrigerant from the condenser to the accumulator. Typically, the two-phase refrigerant is stored in the accumulator in the form of a boiling liquid. The accumulator and, in particular, a housing of the accumulator therefore preferably consists of a material and is designed in such a manner that the accumulator is capable of withstanding the pressure of the boiling liquid refrigerant.

Cavitation in a conveying device discharging the two-phase refrigerant from the accumulator may be counteracted by appropriately subcooling the refrigerant stored in the accumulator. Subcooling of the refrigerant stored in the accumulator typically is accomplished by arranging a refrigerant inlet of the conveying device in a. defined position below a refrigerant outlet disposed in the region of a sump of the accumulator. If the conveying device is arranged relative to the accumulator in such a position that for the conveying device a positive minimum inflow level, which is defined by the level of a liquid column above an inflow edge of a blade of the conveying device, is maintained, the gravity of the liquid column causes a defined pressure increase in the refrigerant supplied to the conveying device thus providing for a subcooling of the refrigerant. Upon installation of a cooling system in an aircraft it is, however, usually difficult to accommodate the system components in the limited installation space available on board the aircraft or, as described above, even position individual components relative to each other such that, for example, the gravity of a liquid column above an inflow edge of a blade of a conveying device can be utilized so as to achieve a pressure increase in a refrigerant supplied to the conveying device and thereby prevent an evaporation of the refrigerant due to the pressure reduction caused by the conveying device.

The accumulator arrangement therefore comprises a subcooler having a refrigerant inlet and a refrigerant outlet. The refrigerant inlet of the subcooler is connected to the refrigerant outlet of the accumulator. Hence, the subcooler serves to subcool the refrigerant exiting the accumulator and thereby ensures that the refrigerant is supplied to a conveying device discharging refrigerant from the accumulator and being disposed downstream of the accumulator in its liquid state of aggregation and sufficiently subcooled such that cavitation in the conveying device due to an unintended evaporation of the refrigerant within the conveying device is prevented. As a result, excess wear of the conveying device due to cavitation can be avoided without it being necessary to arrange the conveying device below the refrigerant outlet of the accumulator in such a position that the gravity of a liquid column above an inflow edge of a blade of the conveying device can be utilized so as to achieve a pressure increase in the refrigerant supplied to the conveying device and thereby prevent an evaporation of the refrigerant. The individual components of the accumulator arrangement and a cooling system equipped with the accumulator in arrangement therefore can be arranged within a limited installation space in a flexible manner. The installation space requirements of the accumulator arrangement and the cooling system thus can be reduced.

In the accumulator arrangement according to the invention the subcooler which serves to cool the refrigerant exiting the accumulator is arranged at least partially within the interior of the accumulator. By incorporating the subcooler at least partially into the accumulator, a particularly small-sized accumulator arrangement can be obtained. Further, the part of the subcooler which is arranged inside the accumulator is protected against environmental influences and hence can be of a light-weight design.

The subcooler may comprise a heat exchanger which at least partially is arranged within the interior of the accumulator. The heat exchanger may for example be a coil heat exchanger or a double tube heat exchanger. These heat exchanger configurations allow an efficient heat transfer from the subcooler to the refrigerant exiting the accumulator, but still have a relatively small installation volume.

Preferably, the refrigerant outlet of the accumulator is disposed in the region of a sump of the accumulator. A tubing connecting the refrigerant outlet of the accumulator to a conveying device for discharging refrigerant from the accumulator may extend from the sump of the accumulator through the interior of the accumulator in the direction of the hat of the accumulator. The tubing may exit the accumulator in a region of a head of the accumulator, hence allowing refrigerant received within the accumulator to be discharged from the accumulator sump via the head of the accumulator. Upon extending through the interior of the accumulator, the tubing connecting the refrigerant outlet of the accumulator to the conveying device may pass through the subcooler. This arrangement allows to very efficiently subcool the refrigerant discharged from the accumulator while simultaneously minimizing the installation volume requirement of the accumulator arrangement.

If desired, the accumulator may be equipped with a level sensor. Signals provided by the level sensor may be transmitted to a control device for controlling the operation of the conveying device. The control device then may control the operation of the conveying device in dependence on the signals provided by the level sensor so as to, for example, start operation of the conveying device if a signal provided by the level sensor indicates that the refrigerant level within the accumulator exceeds a predetermined threshold level.

In a preferred embodiment of the accumulator arrangement, the subcooler and the tubing connecting the refrigerant outlet of the accumulator to the conveying device for discharging refrigerant from the accumulator are formed as an assembly unit which is releasably connected to the accumulator. Combining the subcooler and the tubing to an assembly unit simplifies assembly and maintenance of the accumulator arrangement. The releasable connection between the accumulator and the assembly unit comprising the subcooler and the tubing may be achieved, for example, by screw connections.

Preferably, the condenser and the subcooler of the accumulator arrangement, either by means of separate control units or by means of a common control unit, are controllable independently from each other. In particular, the control unit(s) is/are adapted to start and/or to shut-down operation of the condenser and the subcooler independently from each other. This may be achieved by appropriately controlling the supply of cooling energy from a heat sink to the subcooler and the condenser. Separate heat sinks may be provided to supply cooling energy to the subcooler and the condenser.

In a preferred embodiment of the accumulator arrangement, the subcooler and the condenser, however, are adapted to be supplied with cooling energy by a common heat sink. Nevertheless, the supply of cooling energy from the common heat sink to the subcooler and the condenser, however, preferably still can be controlled independently such that the subcooler and the condenser can be operated independently from each other. The use of a common heat sink for supplying cooling energy to the subcooler and the condenser allows to still further minimize the weight and the installation volume of the accumulator arrangement.

A refrigerant provided by the heat sink preferably first is directed to the subcooler and thereafter to the condenser. This arrangement ensures that the subcooler is provided with sufficient cooling energy for appropriately subcooling the refrigerant discharged from the accumulator. It is, however, also conceivable to supply the refrigerant provided by the heat sink first to the condenser and thereafter to the subcooler. Such an arrangement is advantageous in operational situations of the accumulator arrangement wherein a large amount of cooling energy is required to ensure a proper operation of the condenser, In a particularly preferred embodiment of the accumulator arrangement, the order in which the subcooler and the condenser are supplied with cooling energy by a common heat sink can be varied as desired. This can be achieved, for example, by a suitable design of a tubing connecting the heat sink, the subcooler and the condenser and suitable valves for controlling the flow of a refrigerant from the heat sink to the subcooler and the condenser.

Similar to the subcooler, also the condenser may be arranged at least partially within the interior of the accumulator. This allows to further reduce the volume of the accumulator arrangement. Further, the part of the condenser arranged within the interior of the accumulator is well protected against environmental influences.

The accumulator, the subcooler, the condenser and the heat sink may be formed as an assembly unit. This arrangement is in particular advantageous, if the heat sink is designed in the form of a chiller and both, the subcooler and the condenser, are arranged at least partially within the interior of the accumulator. For maintenance, the assembly unit then can be disconnected from a cooling circuit of a cooling system equipped with the accumulator arrangement without it being necessary to open a primary cooling circuit of the chiller. Instead, the assembly unit comprising the accumulator, the subcooler, the condenser and the heat sink may be disconnected from the cooling system by simply opening the more robust cooling circuit of the cooling system.

In a method of operating an accumulator arrangement for use in a cooling system suitable for operation with a two-phase refrigerant, the two-phase refrigerant is condensed in a condenser. The refrigerant condensed in the condenser is received in an accumulator. Refrigerant discharged from the accumulator is subcooled in a subcooler arranged at least partially within the interior of the accumulator.

The refrigerant is discharged from the accumulator through a tubing connecting a refrigerant outlet of the accumulator, which is disposed in the region of a sump of the accumulator, to a conveying device for discharging refrigerant from the accumulator. The tubing may extend from the sump of the accumulator in the direction of a head of the accumulator thereby passing through the subcooler.

The subcooler and the condenser may be supplied with cooling energy by a common heat sink. A refrigerant provided by the heat sink first may be directed to the subcooler and thereafter to the condenser or vice versa. If desired, the order in which the refrigerant provided by the heat sink is directed to the subcooler and the condenser may be varied.

A cooling system which is in particular suitable for use in an aircraft comprises a cooling circuit allowing circulation of a two-phase refrigerant therethrough. A condenser of the cooling system is disposed in the cooling circuit and has a refrigerant inlet and a refrigerant outlet. The cooling system further comprises an accumulator for receiving the two-phase refrigerant therein. The accumulator has a refrigerant inlet connected to the refrigerant outlet of the condenser and a refrigerant outlet. Finally, the cooling system comprises a subcooler having a refrigerant inlet and a refrigerant outlet, the refrigerant inlet of the subcooler being connected to the refrigerant outlet of the accumulator. The subcooler is arranged at least partially within the interior of the accumulator.

The accumulator arrangement of the cooling system according to the invention may comprise any one of the features described above with respect to the accumulator arrangement according to the invention.

The cooling system further may comprise a bypass line branching off from the cooling circuit downstream of a refrigerant outlet of a conveying device for discharging refrigerant from the accumulator and opening into the accumulator. A valve may be disposed in the bypass line which is adapted to open the bypass line if a pressure difference between the pressure of the refrigerant in the cooling circuit downstream of the refrigerant outlet of the conveying device and the pressure of the refrigerant in the cooling circuit upstream of a refrigerant inlet of the conveying device exceeds a predetermined level. The pressure within the cooling circuit thus can be maintained within a desired range without it being necessary to readjust the operation of the conveying device. Further, the conveying device is protected from excess pressure of the refrigerant in the cooling circuit downstream of the refrigerant outlet of the conveying device, since, via the bypass line, refrigerant can be drained from the cooling circuit downstream of the refrigerant outlet of the conveying device into the accumulator.

The cooling system may further comprise an evaporator disposed in the cooling circuit and having a refrigerant inlet and a refrigerant outlet. The evaporator may form an interface between the cooling circuit and a cooling energy consumer and may, for example, comprise a heat exchanger which provides for a thermal coupling of the refrigerant flowing through the cooling circuit of the cooling system and a fluid to be cooled, such as for example air to be supplied to mobile transport containers for cooling food stored in the mobile transport containers or any heat generating component on board the aircraft. The two-phase refrigerant is supplied to the refrigerant inlet of the evaporator in its liquid state of aggregation. Upon releasing its cooling energy to the cooling energy consumer, the refrigerant is evaporated and thus exits the evaporator at its refrigerant outlet in its gaseous state of aggregation.

Further, a valve may be disposed in the cooling circuit of the cooling system between the refrigerant outlet of the evaporator and the refrigerant inlet of the condenser. The valve may be adapted to control the flow of refrigerant through the cooling circuit such that a defined pressure gradient of the refrigerant in the cooling circuit between the refrigerant outlet of the evaporator and the refrigerant inlet of the condenser is established. The pressure gradient of the refrigerant in the cooling circuit between the refrigerant outlet of the evaporator and the refrigerant inlet of the condenser induces a flow of the refrigerant from the evaporator to the condenser without it being necessary to provide an additional conveying device for conveying the gaseous refrigerant through the cooling circuit. If desired, the cooling system, however, also may be provided with a conveying device for conveying the gaseous refrigerant through the cooling circuit which may, for example, be designed in the form of a compressor.

By controlling the pressure gradient of the refrigerant in the cooling circuit between the evaporator and the condenser, the evaporation of the refrigerant in the evaporator and the condensation of the refrigerant in the condenser is stabilized. In particular, by appropriately controlling the valve disposed in the cooling circuit between the refrigerant outlet of the evaporator and the refrigerant inlet of the condenser, the pressure and hence the temperature of the refrigerant upon evaporation in the evaporator and upon condensation in the condenser can be adjusted within a certain range. Load variations of the evaporator and/or the condenser thus can be compensated for, at least to a certain extent, without it being necessary to immediately adjust the operating parameters of the evaporator and/or the condenser.

In a method of operating a cooling system which is in particular suitable for use on board an aircraft a two-phase refrigerant is circulated through a cooling circuit. The two-phase refrigerant is condensed in a condenser. The refrigerant condensed in the condenser is received in an accumulator. The refrigerant discharged from the accumulator is subcooled in a subcooler being arranged at least partially within the interior of the accumulator.

BRIEF DESCRIPTION OF DRAWINGS

Preferred embodiments of the invention now are explained in more detail with reference to the enclosed schematic drawings wherein.

DETAILED DESCRIPTION OF EMBODIMENTS

Figure 1:
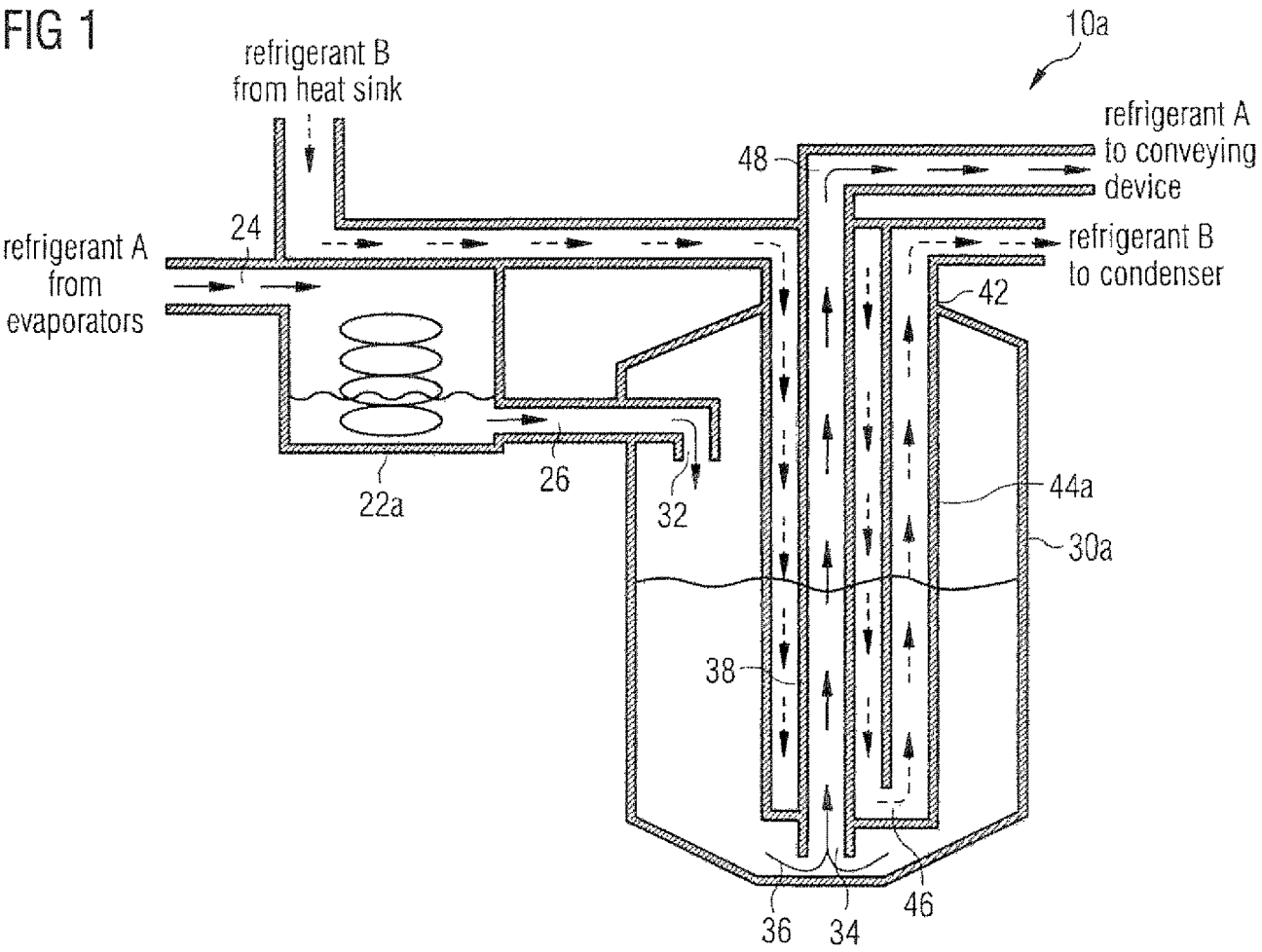
FIG. 1 shows an accumulator arrangement for use in a cooling system suitable for operation with a two-phase refrigerant.
Figure 2:
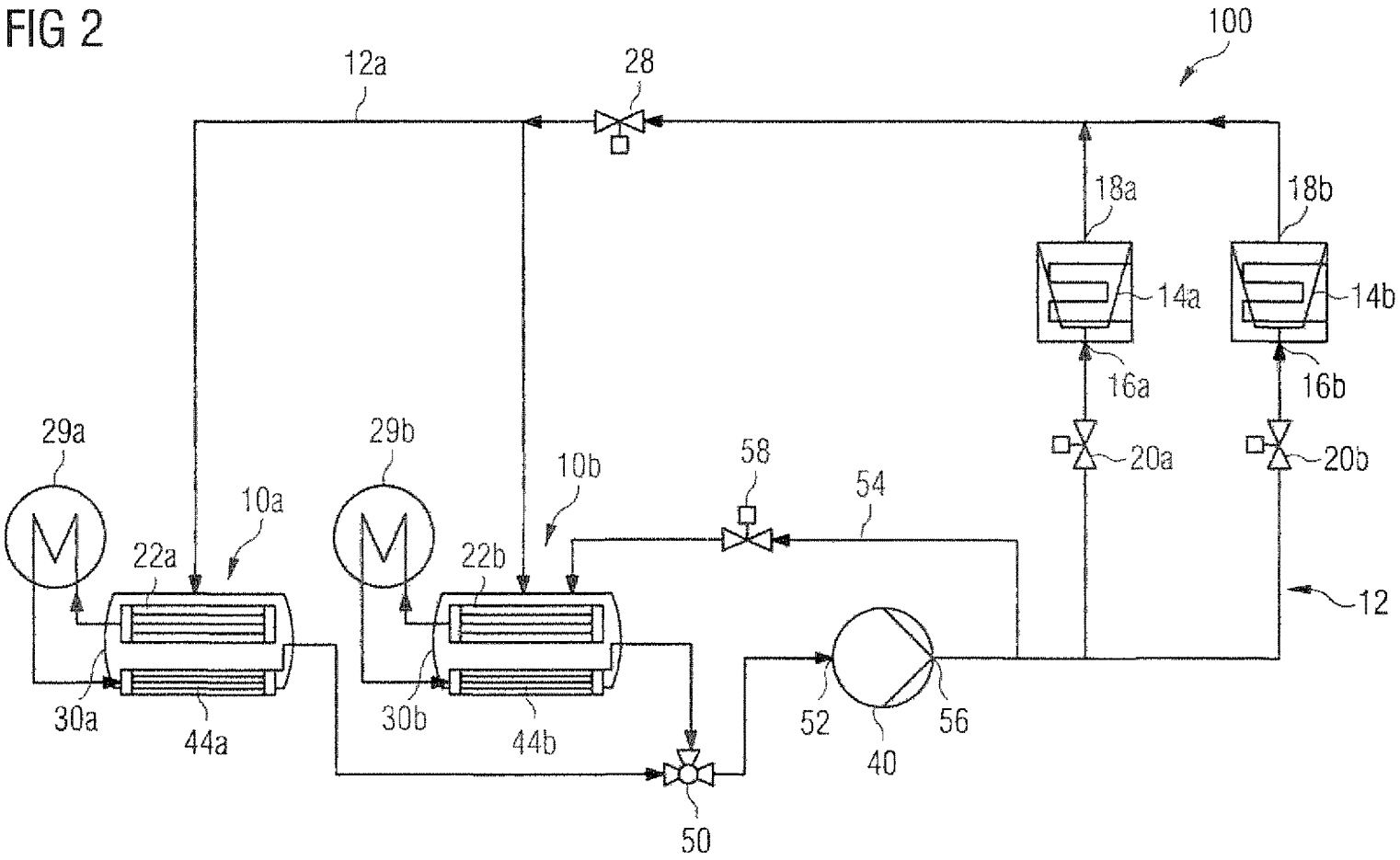
FIG. 2 shows a cooling system suitable for operation with a two-phase refrigerant.

FIG. 1 depicts an accumulator arrangement 10*a*, suitable for use in a cooling system 100, see FIG. 2, which on board an aircraft, for example, may be employed to cool food provided for supplying to the passengers. The cooling system 100 of FIG. 2 comprises a cooling circuit 12 allowing circulation of a two-phase refrigerant A therethrough. The two-phase refrigerant A may for example be $CO_2$, or R134A. A first and a second evaporator 14*a*,, 14*b*, are disposed in the cooling circuit 12. Each evaporator 14*a*,, 14*b*, comprises a refrigerant inlet 16*a*,, 16*b*, and a refrigerant outlet 18*a*,, 18*b*. The refrigerant A flowing through the cooling circuit 12 is supplied to the refrigerant inlets 16*a*,, 16*b*, of the evaporators 14*a*,, 14*b*, in its liquid state of aggregation. Upon flowing through the evaporators 14*a*,, 14*b*,, the refrigerant A releases its cooling energy to a cooling energy consumer which in the embodiment of a cooling system 100 depicted in FIG. 2 is formed by the food to be cooled. Upon releasing its cooling energy, the refrigerant A is evaporated and hence exits the evaporators 14*a*,, 14*b*, at the refrigerant outlets 18*a*,, 18*b*, of the evaporators 14*a*,, 14*b* in its gaseous state of aggregation.

The cooling system 100 usually is operated such that a dry evaporation of the refrigerant occurs in the evaporators 14*a*,, 14*b*. This allows an operation of the cooling system 100 with a limited amount of refrigerant A circulating in the cooling circuit 12. As a result, the static pressure of the refrigerant A prevailing in the cooling circuit 12 in the non-operating state of the cooling system 100 is low, even at high ambient temperatures. Further, negative effects of a leakage in the cooling system 100 are limited. Occurrence of a dry evaporation in the evaporators 14*a*,, 14*b*, however, can only be ensured by an appropriate control of the amount of refrigerant A supplied to the evaporators 14*a*,, 14*b*, in dependence on the operational state of the evaporators 14*a*,, 14*b*,, i.e. the cooling energy requirement of the cooling energy consumers coupled to the evaporators 14*a*,, 14*b*.

The supply of refrigerant A to the evaporators 14*a*,, 14*b*, is controlled by respective valves 20*a*,, 20*b*, which are disposed in the cooling circuit 12 upstream of the first and the second evaporator 14*a*,, 14*b*,, respectively. The valves 20*a*,, 20*b*, may comprise a nozzle for spraying the refrigerant A into the evaporators 14*a*,, 14*b*, and to distribute the refrigerant A within the evaporators 14*a*,, 14*b*. The spraying of the refrigerant A into the evaporators 14*a*,, 14*b*, may be achieved, for example, by supplying refrigerant vapor from the evaporators 14*a*,, 14*b*, to the nozzles of the valves 20*a*,, 20*b*, and/or by evaporation of the refrigerant A due to a pressure decrease of the refrigerant A downstream of the valves 20*a*,, 20*b*.

To ensure occurrence of a dry evaporation in the evaporators 14*a*,, 14*b*,, a predetermined amount of refrigerant A is supplied to the evaporators 14*a*,, 14*b*, by appropriately controlling the valves 20*a*,, 20*b*. Then, a temperature TK1 of the refrigerant A at the refrigerant inlets 16*a*,, 16*b*, of the evaporators 14*a*,, 14*b*, and a temperature TA2 of the fluid to be cooled by the evaporators 14*a*,, 14*b*,, for example air supplied to the cooling energy consumers, is measured, preferably while a fan conveying the fluid to be cooled to the cooling energy consumers is running. Further, the pressure of the refrigerant A in the evaporators 14*a*,, 14*b*, or at the refrigerant outlets 18*a*,, 18*b*, of the evaporators 14*a*,, 14*b*, is measured. If a temperature difference between the temperature TA2 of the fluid to be cooled by the evaporators 14*a*,, 14*b*, and the temperature TK1 of the refrigerant A at the refrigerant inlets 16*a*, 16*b*, of the evaporators 14*a*,, 14*b*, exceeds a predetermined threshold value, for example 8K, and the pressure of the refrigerant A in the evaporators 14*a*,, 14*b*, lies within a predetermined range, the refrigerant A supplied to the evaporators 14*a*,, 14*b* is thoroughly evaporated and possibly also super-heated by the evaporators 14*a*, 14*b*. Hence, the valves 20*a*,, 20*b*, again can be controlled so as to supply a further predetermined amount of refrigerant A to the evaporators 14*a*,, 14*b*.

The cooling system 100 further comprises a first and a second condenser 22*a*,, 22*b*. As becomes apparent from FIG. 1, each condenser 22*a*,, 22*b*, has a refrigerant inlet 24 and a refrigerant outlet 26. The refrigerant A which is evaporated in the evaporators 14*a*,, 14*b*,, via a portion 12*a*, of the cooling circuit 12 downstream of the evaporators 14*a*,, 14*b*, and upstream of the condensers 22*a*,, 22*b*,, is supplied to the refrigerant inlets 24 of the condensers 22*a*,, 22*b*, in its gaseous state of aggregation. The supply of refrigerant A from the evaporators 14*a*,, 14*b*, to the condensers 22*a*, 22*b*, is controlled by means of a valve 28. The valve 28 is adapted to control the flow of refrigerant A through the portion 12*a*, of the cooling circuit 12 such that a defined pressure gradient of the refrigerant A in the portion 12*a*, of the cooling circuit 12 between the refrigerant outlets 18*a*,, 18*b*, of the evaporators 14*a*,, 14*b*, and the refrigerant inlets 24 of the condensers 22*a*,, 22*b*, is adjusted. The pressure gradient of the refrigerant A in the portion 12*a*, of the cooling circuit 12 between the refrigerant outlets 18*a*,, 18*b*, of the evaporators 14*a*,, 14*b*, and the refrigerant inlets 24 of the condensers 22*a*,, 22*b*, induces a flow of the refrigerant A from the evaporators 14*a*, 14*b*, to the condensers 22*a*,, 22*b*.

Each of the condensers 22*a*,, 22*b*, is thermally coupled to a heat sink 29*a*,, 29*b* designed in the form of a chiller. The cooling energy provided by the heat sinks 29*a*, 29*b*, in the condensers 22*a*,, 22*b*, is used to condense the refrigerant A. Thus, the refrigerant A exits the condensers 22*a*,, 22*b*, at respective refrigerant outlets 26, see FIG. 1, in its liquid state of aggregation. Liquid refrigerant A from each of the condensers 22*a*,, 22*b*, is supplied to an accumulator 30*a*,, 30*b*. Within the accumulators 30*a*,, 30*b*, the refrigerant A is stored in the form of a boiling liquid. In the embodiment of an accumulator arrangement 10*a*, shown FIG. 1 the condenser 22*a*, is disposed outside of the accumulator 30*a*. As depicted in FIG. 2, it is, however, also conceivable to arrange the condensers 22*a*,, 22*b*, within the interior of the accumulators 30*a*,, 30*b*.

In the cooling circuit 12, the condensers 22*a*,, 22*b*, form a "low-temperature location" where the refrigerant A, after being converted into its gaseous state of aggregation in the evaporators 14*a*,, 14*b*,, is converted back into its liquid state of aggregation. A particularly energy efficient operation of the cooling system 100 is possible, if the condensers 22*a*,, 22*b*, are installed at a location where heating of the condensers 22*a*, 22*b*, by ambient heat is avoided as far as possible. When the cooling system 100 is employed on board an aircraft, the condensers 22*a*,, 22*b*, preferably are installed outside of the heated aircraft cabin behind the secondary aircraft structure, for example in the wing fairing, the belly fairing or the tail cone. The same applies to the accumulators 30*a*,, 30*b*. Further, the condensers 22*a*,, 22*b*, and/or the accumulators 30*a*,, 30*b*, may be insulated to maintain the heat input from the ambient as low as possible.

As becomes apparent from FIG. 1, each of the accumulators 30*a*,, 30*b*, has a refrigerant inlet 32 connected to the refrigerant outlet 24 of one of the condensers 22*a*,, 22*b*, and a refrigerant outlet 34. The refrigerant outlet 34 of the accumulator 30*a*, shown in FIG. 1 is disposed in the region of a sump 36 of the accumulator 30*a*. A tubing 38 which connects the refrigerant outlet 34 of the accumulator 30*a*, to a conveying device 40 (see FIG. 2) for discharging refrigerant A from the accumulator 30*a*, extends from the sump 36 of the accumulator 30*a*, in the direction of a head 42 of the accumulator 30*a*. The accumulator 30*b*, shown in FIG. 2 may have the same design as the accumulator 30*a*, of FIG. 1.

As shown in FIG. 2, a subcooler 44*a*,, 44*b*, is arranged at least partially within the interior of each of the accumulators 30*a*,, 30*b*. In the accumulator arrangement 10*a* of FIG. 1 a refrigerant inlet 46 of the subcooler 44*a*, is connected to the refrigerant outlet 34 of the accumulator 30*a*. In particular, the tubing 38 connecting the refrigerant outlet 34 of the accumulator 30*a*, to the conveying device 40 passes through the subcooler 44*a*, to a refrigerant outlet 48 of the subcooler 44*a*, which is disposed downstream of the head 42 of the accumulator 30*a*. Refrigerant A which is discharged from the sump 36 of the accumulator 30*a*, through the tubing 38 thus is subcooled upon flowing through the portion of the tubing 38 extending through the subcooler 44*a*. Thus, unintended evaporation of the refrigerant A and hence cavitation in the conveying device 40 which may, for example, be designed in the form of a pump is avoided.

In the accumulator arrangement 10*a*, of FIG. 1 the subcooler 44*a*, comprises a heat-exchanger designed in the form of a double tube heat-exchanger. It is, however, also conceivable to employ a heat-exchanger in the form of a coil heat-exchanger extending around a circumferential wall of the tubing 38. The subcooler 44*b*, depicted in FIG. 2 may have the same design as the subcooler 44*a*, depicted in FIG. 1.

The heat sinks 29*a*,, 29*b*, which serve to supply cooling energy to the condensers 22*a*, 22*b*, also serve to supply cooling energy to the subcoolers 44*a*,, 44*b*. In other words, the heat sink 29*a*, serves as a common heat sink for the condenser 22*a*, and the subcooler 44*a*,, while the heat sink 29*b*, serves as a common heat sink for the condenser 22*b*, and the subcooler 44*b*. Each of the heat sinks 29*a*,, 29*b*, supplies a refrigerant B, which may be a gaseous or liquid refrigerant or also a two-phase refrigerant, to the condensers 22*a*,, 22*b*, and the subcoolers 44*a*,, 44*b*. In the configuration of an accumulator arrangement 10*a*, according to FIG. 1 refrigerant B provided by the heat sink 29*a*,, after flowing through the subcooler 44*a*,, is guided to the condenser 22*a*, where it releases its residual cooling energy so as to cool and hence liquefy the gaseous refrigerant A supplied to the refrigerant inlet 24*a*, of the condenser 22*a*, from the evaporators 14*a*,, 14*b*. It is, however, also conceivable to supply the refrigerant B provided by the heat sink 29*a*, first to the condenser 22*a*, and only thereafter to the subcooler 44*a*, or to control the order in which the condenser 22*a*, and the subcooler 44*a*, are provided with refrigerant B from the heat sink 29*a*, in a variable manner as desired. The thermal coupling of the heat sink 29*b*,, the condenser 22*b*, and the subcooler 44*b*, may be designed as described above in connection with the heat sink 29*a*,, the condenser 22*a*, and the subcooler 44*a*.

As shown in FIG. 2, the refrigerant A exiting the subcoolers 44*a*,, 44*b*,, by means of the conveying device 40, is supplied to the evaporators 14*a*,, 14*b*,, wherein a valve 50 controls the supply of refrigerant A from the subcoolers 44*a*,, 44*b*, to a refrigerant inlet 52 of the conveying device 40. A bypass line 54 branches off from the cooling circuit 12 downstream from a refrigerant outlet 56 of the conveying device 40 and opens into the accumulator 30*b*. A valve 58 disposed in the bypass line 54 is adapted to open the bypass line 54 if a pressure difference between the pressure of the refrigerant A in the cooling circuit 12 downstream of the refrigerant outlet 56 of the conveying device 40 and the pressure of the refrigerant A in the cooling circuit 12 upstream of the refrigerant inlet 52 of the conveying device 40 exceeds a predetermined level. In particular, the valve 58 opens the bypass line 54 if the evaporators 14*a*,, 14*b*, during operation consume less refrigerant A resulting in a pressure increase in the cooling circuit 12 downstream of the refrigerant outlet 56 of the conveying device 40. By draining refrigerant A from the cooling circuit 12 downstream of the refrigerant outlet 56 of the conveying device 40 into the accumulator 30*b*,, the conveying device 40 can be protected from excess pressure and the pressure within the cooling circuit 12 can be maintained within a certain range without it being necessary to adjust the operation of the conveying device 40.

For controlling the start-up of the cooling system 100 there are different options. As a first option, upon start-up of the cooling system 100, all evaporators 14*a*,, 14*b*, are simultaneously supplied with cooling energy. Typically the cooling system 100 will be designed for this start-up mode of operation. It is, however, also conceivable to control the supply of cooling energy to the evaporators 14*a*,, 14*b*, upon start-up of the cooling system 100 such that at first only selected ones of the evaporators 14*a*,, 14*b* are supplied with cooling energy until a predetermined target temperature of the selected evaporators 14*a*,, 14*b*, supplied with cooling energy is reached, Only then also the remaining evaporators 14*a*,, 14*b*, may be supplied with cooling energy. In this start-up mode of operation the amount of heat to be discharged by means of the cooling system 100 is smaller than in a mode of operation wherein all evaporators 14*a*,, 14*b*, are simultaneously supplied with cooling energy. Hence, heat sinks 29*a*, 29*b*, designed in the form of chillers can be operated at lower temperatures allowing heat to be discharged from the cooling energy consumers rather quickly due to the large temperature difference between the operating temperature of the heat sinks 29*a*,, 29*b*, and the temperature of the cooling energy consumers.

Finally, it is also conceivable to control the supply of cooling energy to the evaporators 14*a*,, 14*b*, upon start-up of the cooling system 100 such that at first all evaporators 14*a*,, 14*b*, are simultaneously supplied with cooling energy until a predetermined intermediate temperature of the evaporators 14*a*,, 14*b*, is reached. Immediately after start-up of the cooling system 100 the temperature difference between the operating temperature of heat sinks 29*a*,, 29*b*, designed in the form of chillers and the temperature of the cooling energy consumers still is high allowing a quick removal of heat from the cooling energy consumers. After reaching the predetermined intermediate temperature of the evaporators 14*a*,, 14*b*, the operating temperature of the heat sinks 29*a*,, 29*b*, may be reduced and further cooling energy may be supplied only to selected ones of the evaporators 14*a*,, 14*b*, until a predetermined target temperature of the selected evaporators 14*a*,, 14*b*, supplied with cooling energy is reached. Finally, the remaining evaporators 14*a*,, 14*b*, may be supplied with cooling energy until a predetermined target temperature is reached. also for these evaporators 14*a*,, 14*b*. Again a quick removal of heat from the cooling energy consumers may be achieved due to the large temperature difference between the operating temperature of the heat sinks 29*a*,, 29*b*, and the temperature of the cooling energy consumers.

The invention claimed is:

1. An accumulator arrangement for use in a cooling system suitable for operation with a two-phase refrigerant, the accumulator arrangement comprising:

a condenser having a refrigerant inlet and a refrigerant outlet, an accumulator for receiving the two-phase refrigerant therein, the accumulator having a refrigerant inlet connected to the refrigerant outlet of the condenser a tubing forming a refrigerant outlet of the accumulator in the region of a sump of the accumulator, the tubing extending from the sump of the accumulator through the interior of the accumulator in the direction of a head of the accumulator and exiting the accumulator in a region of the head of the accumulator, the tubing connecting the formed refrigerant outlet of the accumulator to a conveying device for discharging refrigerant from the accumulator, the discharging refrigerant running in the tubing from the sump of the accumulator to the region of the head of the accumulator, and a subcooler having a refrigerant inlet and a refrigerant outlet, the refrigerant inlet of the subcooler being connected to the refrigerant outlet of the accumulator, and the subcooler being arranged at least partially within the interior of the accumulator, wherein the tubing extending from the sump of the accumulator to the region of the head of the accumulator passes through the subcooler in the interior of the accumulator.

2. The accumulator arrangement according to claim 1, wherein the subcooler comprises a heat exchanger comprising a coil heat exchanger or a double tube heat exchanger.

3. The accumulator arrangement according to claim 1, wherein the subcooler and the tubing connecting the refrigerant outlet of the accumulator to the conveying device for discharging refrigerant from the accumulator are formed as an assembly unit which is releasably connected to the accumulator.

4. The accumulator arrangement according to claim 1, wherein the subcooler and the condenser are configured to be supplied with cooling energy by a common heat sink, wherein a refrigerant provided by the heat sink first is directed to the subcooler and thereafter to the condenser or vice versa.

5. The accumulator arrangement according to claim 4, wherein the heat sink supplying cooling energy to the subcooler and the condenser comprises a chiller.

6. The accumulator arrangement according to claim 1, wherein the condenser is arranged at least partially within the interior of the accumulator.

7. The accumulator arrangement according to claim 6, wherein the accumulator, the subcooler, the condenser and the heat sink are formed as an assembly unit.

8. A method of operating an accumulator arrangement for use in a cooling system suitable for operation with a two-phase refrigerant, the method comprising the steps of:

condensing the two-phase refrigerant in a condenser, receiving the refrigerant condensed in the condenser in an accumulator, discharging the refrigerant from the accumulator to a conveying device through a tubing forming a refrigerant outlet of the accumulator in the region of a sump of the accumulator, the tubing extending from the sump of the accumulator through the interior of the accumulator in the direction of a head of the accumulator and exiting the accumulator in a region of the head of the accumulator, the tubing connecting the formed refrigerant outlet of the accumulator to the conveying device, and subcooling the refrigerant discharged from the accumulator in a subcooler being arranged at least partially within the interior of the accumulator, wherein the tubing extending from the sump of the accumulator to the region of the head of the accumulator passes through the subcooler in the interior of the accumulator, wherein discharging the refrigerant includes moving the refrigerant in the tubing from the sump of the accumulator to the region of the head of the accumulator.

9. The method according to claim 8, wherein the subcooler and the condenser are supplied with cooling energy by a common heat sink, wherein a refrigerant provided by the heat sink first is directed to the subcooler and thereafter to the condenser or vice versa.

10. A cooling system, in particular for use on board an aircraft, the cooling system comprising:

a cooling circuit allowing circulation of a two-phase refrigerant therethrough, a condenser disposed in the cooling circuit and having a refrigerant inlet and a refrigerant outlet, an accumulator for receiving the two-phase refrigerant therein, the accumulator having a refrigerant inlet connected to the refrigerant outlet of the condenser, a tubing forming a refrigerant outlet of the accumulator in the region of a sump of the accumulator, the tubing extending from the sump of the accumulator through the interior of the accumulator in the direction of a head of the accumulator and connecting exiting the accumulator in a region of the head of the accumulator, the tubing connecting the formed refrigerant outlet of the accumulator to a conveying device for discharging refrigerant from the accumulator, the discharing refrigerant running in the tubing from the sum of the accumulator to the region of the head of the accumulator, and a subcooler having a refrigerant inlet and a refrigerant outlet, the refrigerant inlet of the subcooler being connected to the refrigerant outlet of the accumulator and the subcooler being arranged at least partially within the interior of the accumulator, wherein the tubing extending from the sump of the accumulator to the region of the head of the accumulator passes through the subcooler in the interior of the accumulator.

11. The cooling system according to claim 10, wherein a bypass line branching off from the cooling circuit downstream of a refrigerant outlet of a conveying device for discharging refrigerant from the accumulator opens into the accumulator, wherein a valve disposed in the bypass line is adapted to open the bypass line if a pressure difference between the pressure of the refrigerant in the cooling circuit downstream of the refrigerant outlet of the conveying device and the pressure of the refrigerant in the cooling circuit upstream of a refrigerant inlet of the conveying device exceeds a predetermined level.

12. The cooling system according to claim 10, further comprising:

an evaporator disposed in the cooling circuit and having a refrigerant inlet and a refrigerant outlet, and a valve disposed in the cooling circuit between the refrigerant outlet of the evaporator and the refrigerant inlet of the condenser, the valve being configured to control the flow of refrigerant through the cooling circuit such that a defined pressure gradient of the refrigerant in a portion of the cooling circuit between the refrigerant outlet of the evaporator and the refrigerant inlet of the condenser is adjusted.

13. A method of operating a cooling system, in particular for use on board an aircraft, the method comprising the steps of:

circulating a two-phase refrigerant through a cooling circuit by a conveying device, condensing the two-phase refrigerant in a condenser, receiving the refrigerant condensed in the condenser in an accumulator, discharging the refrigerant from the accumulator through a tubing forming a refrigerant outlet of the accumulator in the region of a sump of the accumulator, the tubing extending from the sump of the accumulator through the interior of the accumulator in the direction of a head of the accumulator and exiting the accumulator in a region of the head of the accumulator, the tubing connecting the formed refrigerant outlet of the accumulator to the conveying device, and subcooling refrigerant discharged from the accumulator in a subcooler being arranged at least partially within the interior of the accumulator, wherein the tubing extending from the sump of the accumulator in the direction of the head of the accumulator passes through the subcooler in the interior of the accumulator, wherein discharging the refrigerant includes moving the refrigerant in the tubing from the sump of the accumulator to the region of the head of the accumulator.

* * * * *